US008596945B2

(12) United States Patent
Knoch et al.

(10) Patent No.: US 8,596,945 B2
(45) Date of Patent: Dec. 3, 2013

(54) DEVICE FOR FILLING OVEN CHAMBERS OF A COKE OVEN

(75) Inventors: Ralf Knoch, Recklinghausen (DE); Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 682 days.

(21) Appl. No.: 12/864,558

(22) PCT Filed: Jan. 27, 2009

(86) PCT No.: PCT/EP2009/000490

§ 371 (c)(1), (2), (4) Date: Oct. 19, 2010

(87) PCT Pub. No.: WO2009/100815

PCT Pub. Date: Aug. 20, 2009

(65) Prior Publication Data

US 2011/0044789 A1 Feb. 24, 2011

(30) Foreign Application Priority Data

Feb. 11, 2008 (DE) ..... 10 2008 008 713

(51) Int. Cl.
*C10B 31/04* (2006.01)

(52) U.S. Cl.
USPC ..... 414/163; 202/262; 414/164; 414/199

(58) Field of Classification Search
USPC ..... 202/262; 414/162, 163, 164, 167, 172, 414/179, 187, 188, 199
See application file for complete search history.

(56) References Cited

U.S. PATENT DOCUMENTS

| | | | | |
|---|---|---|---|---|
| 3,576,263 | A * | 4/1971 | Abendroth | 414/199 |
| 3,958,700 | A * | 5/1976 | Foy et al. | 414/163 |
| 4,040,910 | A * | 8/1977 | Knappstein et al. | 414/163 |
| 4,066,175 | A * | 1/1978 | Schulte | 414/199 |
| 4,242,027 | A * | 12/1980 | Stratmann et al. | 414/148 |
| 4,321,112 | A * | 3/1982 | Galow et al. | 202/241 |
| 4,708,571 | A * | 11/1987 | Sappok | 414/412 |
| 5,384,015 | A * | 1/1995 | Schroter et al. | 202/251 |
| 6,099,229 | A | 8/2000 | Knoch | |
| 2010/0314234 | A1* | 12/2010 | Knoch et al. | 202/262 |

FOREIGN PATENT DOCUMENTS

EP 1293552 B 8/2005

* cited by examiner

*Primary Examiner* — James Keenan
(74) *Attorney, Agent, or Firm* — Andrew Wilford

(57) ABSTRACT

An apparatus for charging chambers of a coke oven has a horizontal screw conveyor with a downwardly open outlet and a telescopic charging chute below the outlet having an upper intake funnel and a telescopic lower part alignable with the charging ports by horizontal and longitudinal displacement. A support frame carries the intake funnel and a lifter for vertically displacing the telescopic lower part. A traveling frame in which the support frame moves transversely can also move longitudinally on rails. A seal on a top side of the support frame surrounds the intake funnel of the telescopic charging chute, works together with a horizontal lower flange surface on the outlet of the horizontal screw conveyor, and permits horizontal movement of the intake funnel relative to the outlet of the horizontal screw conveyor.

16 Claims, 4 Drawing Sheets

DEVICE FOR FILLING OVEN CHAMBERS OF A COKE OVEN

CROSS REFERENCE TO RELATED APPLICATIONS

This application is the US-national stage of PCT application PCT/EP2009/000490, filed 27 Jan. 2009, published 20 Aug. 2009 as WO2009/100815, and claiming the priority of German patent application 102008008713.0 itself filed 11 Feb. 2008.

FIELD OF THE INVENTION

The invention relates to an apparatus for charging chambers of a coke oven having

- a horizontal screw conveyor mounted underneath a coal-charging larry cart,
- a telescopic charging chute below an outlet of the horizontal screw conveyor and having an intake funnel and a telescopic lower part that can be lowered vertically onto charging ports in the top wall of the coke oven, and
- a lifter for vertically displacing the telescopic lower part, the telescopic charging chute being adjustable horizontally in two mutually orthogonal directions for alignment with the particular positions of the charging ports relative to the coal-charging larry cart.

BACKGROUND OF THE INVENTION

An apparatus having the described features is known from EP 1 293 552. The horizontal screw conveyor and the telescopic charging chute of this known apparatus are unified into an operating unit mounted underneath a coal-charging larry cart so it is adjustable in two directions. With the known measures, the horizontal screw conveyor is suspended from an adjustment carriage on a track on the lower side of the coal-charging larry cart. The horizontal screw conveyor is movably displaceable transversely to this track direction on profiles of the adjustment carriage. By dual-axis adjustment of the operating unit, the telescopic charging chute can be aligned with the particular location of the coal charging ports in the top wall of the coke oven, so that the telescopic charging chute attached to an outlet of the horizontal screw conveyor may always be lowered vertically into the charging-port jamb of the charging port to form a seal. However, the transition between the coal outlet of the coal-charging larry cart and an intake funnel of the horizontal screw conveyor is problematic. This transition area must be sealed to avoid emissions. In the known apparatus, a compensator is used that must compensate for lateral adjustment movements of the operating unit in two directions. The coal outlet of the charging cart has a larger outlet cross-section, so that a compensator having large dimensions must be used. During lateral movement of the operating unit, the compensator is strained significantly. A further, more severe disadvantage of the known apparatus is that the known configuration requires a great deal of vertical clearance between the coal outlet on the lower side of the coal-charging larry cart and the top wall of the coke oven. This is not always available. Furthermore, suspension of the horizontal screw conveyor that is movable in two directions, has a complex construction. The known apparatus is unsuitable or is only suitable with restrictions for retrofitting existing coke oven installations.

The object of the invention is to provide an apparatus for emission-free charging of chambers of a coke oven that requires less space, may compensate for large positional deviations of the charging ports, and is suitable for retrofitting existing coke oven installations.

Starting with an apparatus having the features described above, the object is attained according to the invention in that the intake funnel of the telescopic charging chute and the lifter connected to the telescopic charging chute bottom part are mounted on a support frame that is mounted so it is movable in a straight line in a first direction inside a traveling frame, the traveling frame being horizontally movable in a second direction on rails mounted on the lower side of the coal-charging larry cart, and a seal being provided on the top side of the traveling frame, surrounding the intake funnel of the telescopic charging chute, working together with a horizontal flange surface on the surface of the outlet of the horizontal screw conveyor, and permitting horizontal movement of the intake funnel relative to the outlet of the horizontal screw conveyor.

In the ideal case, the charging ports in the top wall of a coke oven are equidistantly spaced and aligned in the travel direction of the coal-charging larry cart. The real conditions on a coke oven often deviate from this ideal case. In particular in older coke ovens, the positions of the charging ports deviate in both directions (X, Y) and are frequently more than 50 mm. The apparatus according to the invention is based on the idea of compensating for deviations of the charging port axes in the X and Y directions by horizontal adjustment of the telescopic charging chute. To this end, the telescopic charging chute and its vertical lifter are decoupled according to the invention from the outlet of the horizontal screw conveyor and mounted in a chassis formed by a traveling frame and a support frame that is linearly shiftable in the traveling frame so it can shift horizontally in two directions. The support frame and the traveling frame are movable independently of each other in directions perpendicular to each other. Position deviations of the charging-port jambs can be compensated for by sequential stepped movement of the traveling frame and the support frame or by simultaneous adjustment of these parts. The overall height of the chassis comprising the traveling frame and the support frame is low, so that older coke ovens may also be equipped with the apparatus according to the invention. Furthermore, a small mass is to be moved for adjustment of the telescopic charging chute, which simplifies the technical implementation of the concept according to the invention.

After the telescopic charging chute has been positioned exactly above a charging port by adjusting the traveling frame and the support frame, the telescopic charging chute executes a purely vertical movement toward the charging-port jamb by the lifter and comes into contact in the charging-port jamb without being inclined. This way, a good seal is formed with the charging-port jamb so that no emissions can escape to the surroundings during the charging procedure.

The rails for guiding the traveling frame preferably extend in the travel direction of the coal-charging larry cart (Y direction), while the support frame is guided movably on the traveling frame transversely thereto and parallel to the chamber longitudinal axes (X axis).

The traveling frame and the support frame preferably lie in a common plane. Such a configuration results in a very low overall height of the chassis comprising the traveling and support frames. The traveling and support frames are advantageously made of U-profiles, rollers running in the U-profiles of the traveling frame being mounted on the support frame. The traveling frame is also equipped with rollers and runs in a track secured below the horizontal screw conveyor of the coal-charging larry cart. The rails for the traveling frame preferably are U-profiles suspended by beams on the coal-charging larry cart and horizontally open. The rollers mounted on the traveling frame engage in these U-profiles that open on one side, and run in them.

The support frame carries the complete telescopic charging chute including its vertical lifter. This lifter for the telescopic charging chute has a lifting frame guided on a vertical beam and is movable along the vertical beam by a hydraulic actuator that is connected to the telescopic lower part by pivoted links. The vertical beam of the lifter is fixed to the support frame horizontally offset from the horizontal screw conveyor.

To avoid emissions during the charging of the coke chambers of a coke oven, a seal is provided on the top side of the support frame, surrounds the intake funnel of the telescopic charging chute, and presses against a horizontal flange surface on the periphery of the outlet of the horizontal screw conveyor during coal charging. The seal is preferably adjustable in operation in such a way that the seal does not touch the adjacent flange surface during horizontal adjustment of the telescopic charging chute and presses against the flange surface to form a seal only during coal charging. The seal on the top side of the support frame can in particular be formed as a diaphragm or as a bellow or hose seal that is held in an annular chamber and can be expanded by compressed air or another pressure medium. The intake funnel of the telescopic charging chute is cylindrical and is surrounded by a cylindrical region of the telescopic lower part. A peripheral seal is also provided on the outer surface between the cylindrical region of the intake funnel and the cylindrical region of the telescopic lower part and can preferably be changed while in service to and permit an essentially contactless adjustment movement of the telescopic lower part. The peripheral seal can also be a hose, bellows, or diaphragm and be connected to a pressure source, like the seal on the top side of the support frame. During operating movements of the telescopic charging chute in the horizontal or vertical directions, the seals are relieved of pressure, so that the parts to be sealed are freely movable relative to one another. If the telescopic charging chute has reached its final position for the charging procedure, the seals are filled with compressed air or another pressure medium. Due to the pressurization, the seals bulge outward and press against the respective surfaces of the parts to be sealed. An optimum tightness is ensured during the charging procedure in this way.

Respective hydraulic actuators are preferably used for horizontally moving the support frame and the traveling frame. According to a preferred embodiment of the invention, hydraulic actuators equipped with proximity detectors are attached to the support frame and to the traveling frame.

The hydraulic actuators are connectable to a machine controller of the coal-charging larry cart, in which data about the positions of the charging ports in the top wall of the coke oven are held. The deviations of the charging-port jamb in the X and Y directions from the ideal position are detected by measuring technology at every charging-port jamb and stored in the machine controller of the coal-charging larry cart. Because of the relation of these deviations to each charging-port jamb and each chamber, the telescopic charging chute may already be individually adjusted by the apparatus according to the invention during travel of the coal-charging larry cart or alternatively after positioning the coal-charging larry cart over the chamber to be charged in such a way that the telescopic charging chute is oriented concentrically to the charging-port jamb and can be lowered into the charging-port jamb by a purely vertical movement. Lateral movements and inclined positions of telescopic parts of the telescopic charging chute are avoided by the solely vertical movement. This ensures that all of the parts of the telescopic charging chute function optimally and no emissions escape into the surroundings during the charging procedure.

A further embodiment of the apparatus according to the invention provides that the hydraulic actuators work together with an optical distance sensor mounted on the coal-charging larry cart and detecting the actual positions of the charging ports. The distance measurements are relayed directly to the controller of the hydraulic cylinders that then move the telescopic charging chute horizontally into a position assigned to the position of the charging-port jamb.

An apparatus for charging chambers of the coke oven usually also has a lid lifter for handling a lid closing the charging port as well as a device for cleaning the charging-port jamb. The lid lifter and the cleaner for the charging-port jamb can be integrated into the apparatus according to the invention. In a further embodiment, the invention teaches that at least one carriage is provided inside the support frame, movable along the profiles of the support frame and used as a carrier for a lid lifter or a cleaner of the charging-port jamb. The lid lifter provided on the carriage has a vertically adjustable support arm movable by a positioning movement of the carriage into a free space between the raised telescopic lower part of the telescopic charging chute and the charging-port jamb and equipped with an apparatus for detecting a lid closing the charging port or for cleaning the charging-port jamb. A hydraulic actuator engaging the carriage is advantageously also used for horizontally positioning the carriage.

BRIEF DESCRIPTION OF THE DRAWING

The invention is described below with reference to a drawing that shows a single embodiment. In the schematic figures

DETAILED DESCRIPTION OF THE INVENTION

Figure 1:
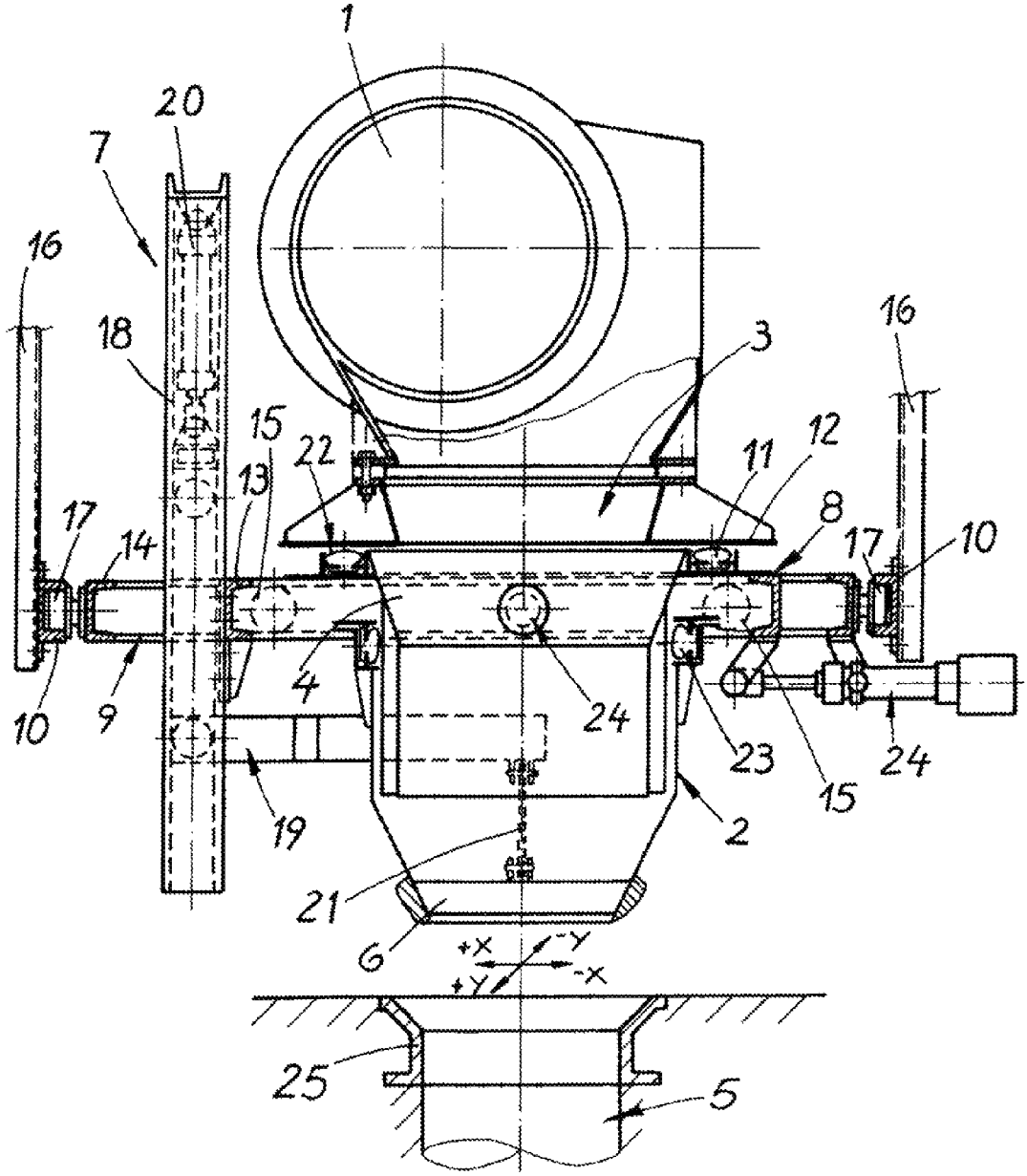
FIG. 1 shows an apparatus for charging chambers of a coke oven.

The basic construction of the apparatus shown in FIGS. 1 through 3 includes a horizontal screw conveyor 1 mounted underneath an unillustrated coal-charging larry cart, a telescopic charging chute 2 below an outlet 3 of the horizontal screw conveyor and has an intake funnel 4 and a telescopic lower part 6 that can be lowered vertically onto charging ports 5 in the top wall of the coke oven, as well as a lifter 7 for vertically displacing the telescopic lower part 6. The telescopic charging chute 2 is adjustable horizontally in first and second directions X, Y that are orthogonal to one another to align with the positions of the charging ports 5 relative to the coal-charging larry cart.

The intake funnel 4 of the telescopic charging chute 2 and the lifter 7 connected to the telescopic lower part 6 are mounted on a support frame 8 oriented so it is movable in a straight line in a traveling frame 9 in the first direction X. The traveling frame 9 is mounted so it is horizontally movable in the second direction Y on rails 10 mounted on the lower side of the coal-charging larry cart. Furthermore, a seal 11 provided on the top side of the support frame 8 around the intake funnel 4 of the telescopic charging chute works together with a horizontal flange surface 12 on the periphery of the outlet 3 of the horizontal screw conveyor 1, and permits horizontal adjustment movements of the intake funnel 4 relative to the outlet 3 of the horizontal screw is conveyor 1 in the two directions X, Y. In the embodiment shown in FIGS. 1 through 3, the rails 10 for guiding the traveling frame 9 extend in the travel direction Y of the coal-charging larry cart. The support frame 8 is guided on the traveling frame 9 so it is movable transversely thereto in the direction X in which the coke-oven chambers are elongated.

Figure 2:
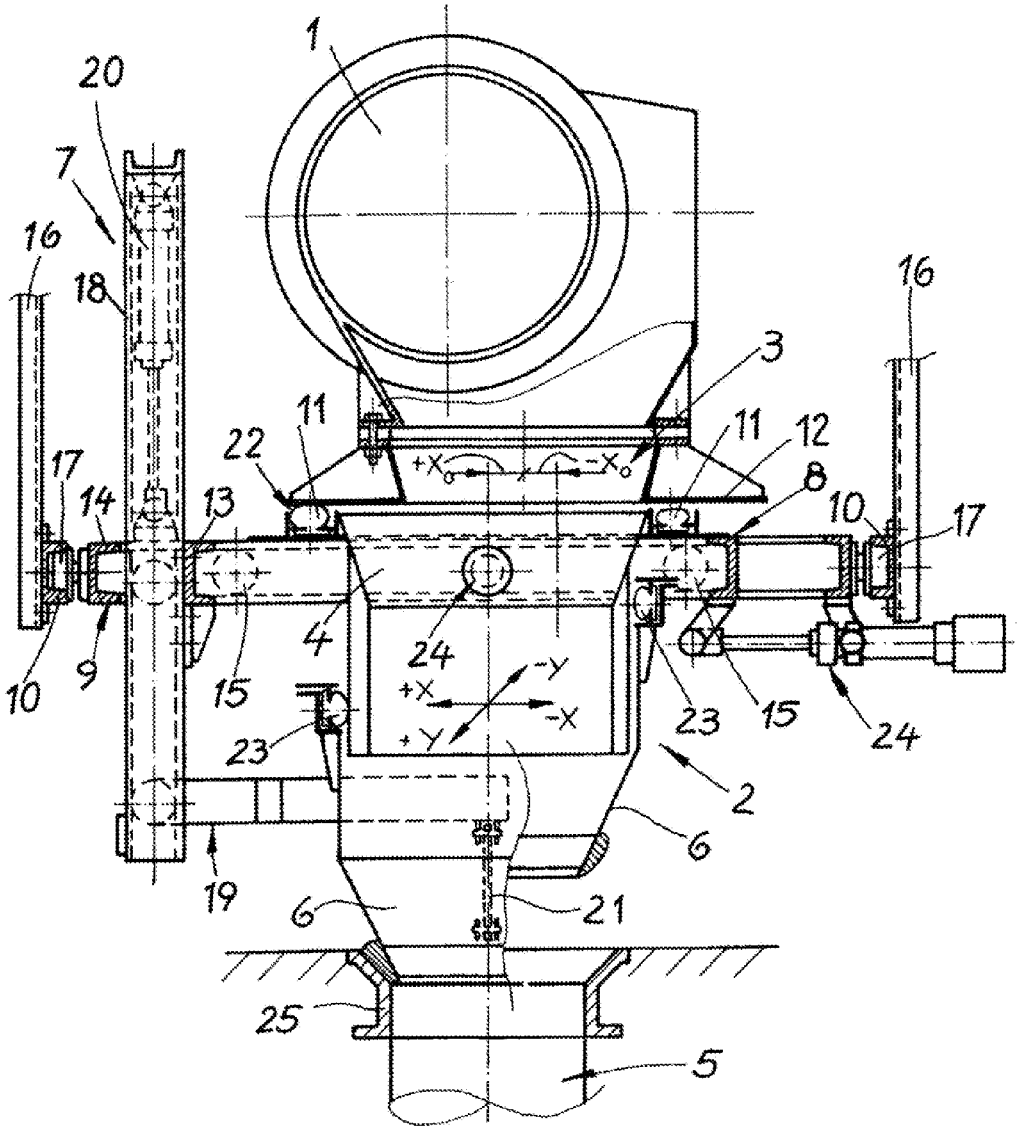
FIG. 2 shows other functional positions of the apparatus shown in FIG. 1.
Figure 3:
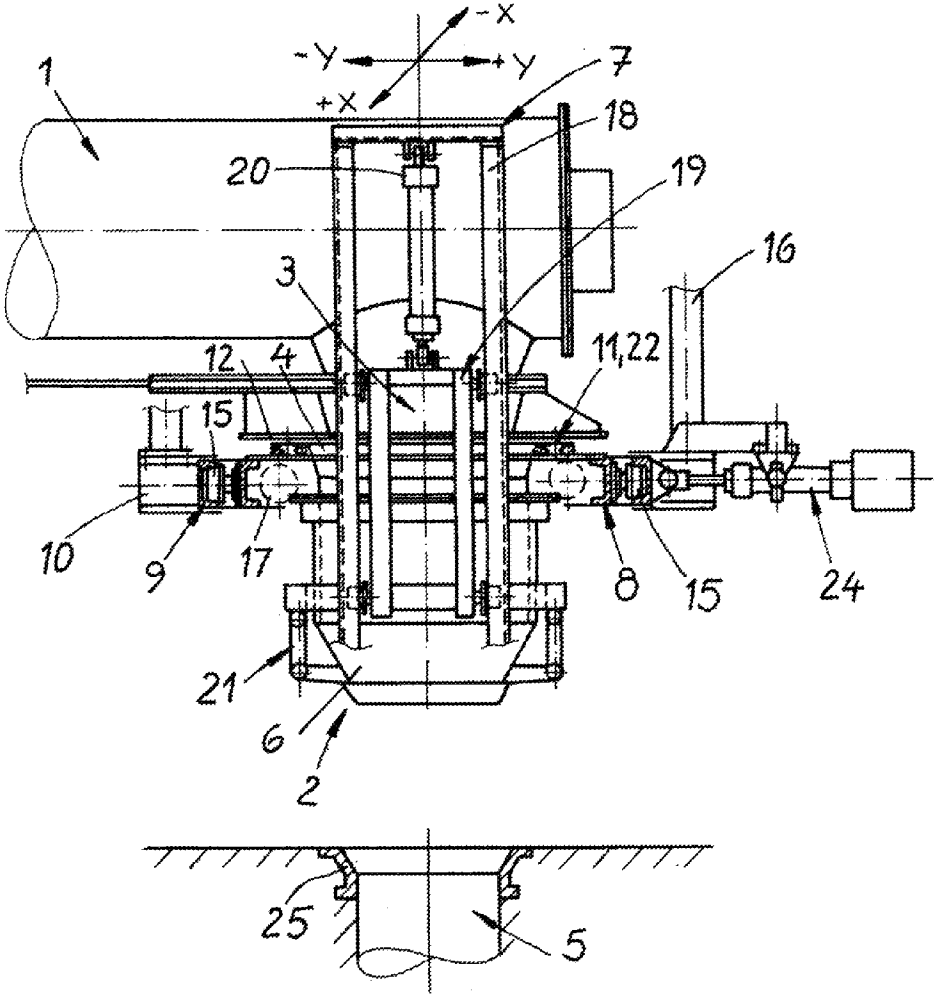
FIG. 3 is a side view of the apparatus shown in FIG. 1.

It is obvious from the illustrations in FIGS. 1 through 3 that the traveling frame 9 and the support frame 8 lie in a common plane. Both frames are constructed from U-profiles 13, 14. Rollers 15 mounted on the support frame 8 run in the U-rails 14 of the traveling frame 9. The rails 10 for the traveling frame 9 are also of U-section, are suspended by beams 16 from the unillustrated coal-charging larry cart, and are horizontally open. Rollers 17 that run in the horizontally open rails 10 are mounted on the traveling frame 9. The traveling frame 9 and the support frame 8 inside the traveling frame form a chassis that permits horizontal adjustment of the telescopic charging chute in the X and Y directions.

The lifter 7 for the telescopic charging chute 2 has a lifting frame 19 guided on a vertical beam 18. The lifting frame 19 is movable along the vertical beam 18 by a hydraulic actuator 20 and is connected by pivoted links 21 to the telescopic lower part 6. The vertical adjustment movement is schematically shown in FIG. 2. Furthermore, the support frame 8 has been displaced in the X direction relative to a central location by an offset $X_0$ in FIG. 2. The positioning distances $X_0$, $Y_0$ in both directions are ±100 to ±150 mm, for example. The vertical beam 18 of the lifter 7 is fixed to the support frame 8 horizontally to the side of the horizontal screw conveyor 1.

The seal 11 on the top side of the support frame 8 is a diaphragm, bellows, or hose. It is accommodated in an annular chamber 22 and is expandable by compressed air. The seal 11 is thus adjustable in operation so that it does not touch the flange surface 12 surrounding the outlet of the horizontal screw conveyor during horizontal adjustment of the telescopic charging chute 2 and presses against the flange surface 12 to form a seal during coal charging to seal the gap between the flange and the top side of the support frame 8.

The intake funnel 4 of the telescopic charging chute 2 has a cylindrical region that is surrounded by a cylindrical region of the telescopic lower part. A peripheral seal 23 is provided on the surface between the cylindrical region of the intake funnel 4 and the cylindrical region of the telescopic lower part 6 and is also changeable in operation and permits an essentially contactless adjustment movement of the telescopic lower part 6.

Hydraulic actuators 24 equipped with proximity detectors are attached to the support frame 8 and the traveling frame 9. The hydraulic actuators 24 are connectable to a machine controller provided on the coal-charging larry cart and in which data corresponding to the positions of the charging ports 5 in the top wall of the coal furnace are stored. Alternatively, the hydraulic actuators 24 may work together with an optical distance sensor provided on the coal-charging larry cart and detecting the position of the charging ports 5.

The described apparatus allows a very precise orientation of the telescopic charging chute 2 relative to the charging ports 5 in the top wall of a coke oven and is capable of compensating for operationally caused position deviations of the charging ports from a predefined basic position in the X and Y directions. In older coking plants, the position deviations may often be in the magnitude from ±100 to 150 mm in both directions X, Y. The horizontal position deviations X, Y of the charging-port jamb 25 are measured in the longitudinal and transverse directions and stored for each charging-port jamb in the machine controller on the coal-charging larry cart and updated as needed. The coal-charging larry cart is moved along the top wall of the coke oven and positioned, without taking the position deviations of the charging ports 5 into consideration, at a predefined point assigned to the charging port to charge a chamber. The positioning may, for example, be performed at high positioning precision with the aid of an automatic positioning system. The alignment of the telescopic charging chute 2 to the actual position of the charging-port jamb 25 is subsequently performed. To this end, the traveling frame 9 and the support frame 8 are brought into a position conforming to the actual position of the charging-port jamb in accordance with the stored X/Y values for the position deviation of the charging-port jamb 25. The telescopic lower part 6 of the telescopic charging chute 2 is then lowered vertically into the charging-port jamb 25. After the telescopic lower part 6 is completely lowered, the seals 11, 23 on the top side of the support frame and around the periphery between the telescopic lower part 6 and the intake funnel 4 of the telescopic charging chute 2 are activated by pressurization with air. Due to the pressurization, the seals 11, 23 expand or bulge and press against the respective contact surfaces. After charging is completed, the seals 11, 23 are deactivated again before the telescopic lower part 6 is lifted and then is subsequently raised. The traveling frame 9 and the support frame 8 can then be moved back into a starting position, for example, during a return trip of the coal-charging larry cart to the coal tower.

Figure 4:
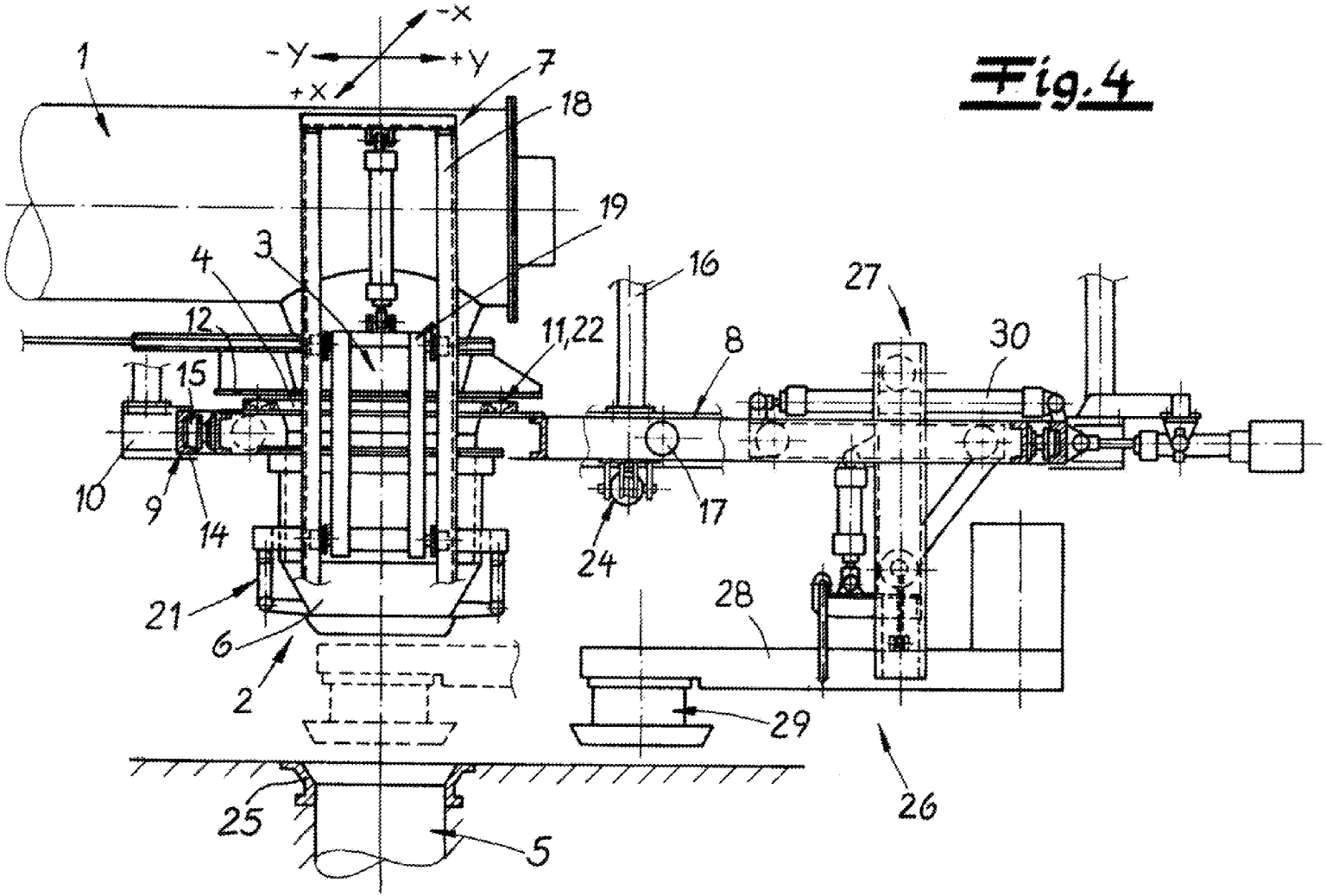
FIG. 4 shows an apparatus for charging chambers of a coke oven having an integrated lid lifter.

In the embodiment shown in FIG. 4, a lid lifter 26 is also integrated into the described apparatus. The lid lifter 26 is mounted on a carriage 27 provided inside the support frame 8 and movable along the profiles 13 of the support frame 8. The lid lifter 26 has a vertically adjustable support arm 28 movable by the carriage 27 into a free space between the raised telescopic lower part 6 of the telescopic charging chute 2 and the charging-port jamb 25 and is equipped with a device 29 for detecting a lid in the charging port and/or for cleaning a lid. A hydraulic actuator 30 for adjusting the carriage 27 is supported on the support frame 8 and acts on the carriage 27.

It is also within the scope of the invention that a cleaner the charging-port jamb is fixed to the carriage 27 or a further carriage also is provided inside the support frame 8 and movable along the profiles of the support frame.

After the telescopic charging chute 2 has been aligned with the position of the charging-port jamb 25 by travel movements of the traveling frame 9 and the support frame 8, before the telescopic lower part 6 is lowered, the lid lifter 26 is first brought into position by a positioning movement of the carriage 27. The carriage 27 executes a predefined constant positioning travel, the apparatus for detecting a lid closing the charging port being placed centrally over the lid. The lid is unscrewed from the charging port. The lid can be raised by a vertical positioning movement of the support arm 28 and can be removed from the area of the telescopic charging chute 2 by a return trip of the carriage 27. The telescopic lower part 6 is subsequently lowered into the charging-port jamb 25 and the coke chamber is charged. After ending the charging procedure and after raising the telescopic lower part 6 out of the charging-port jamb 25, the lid is inserted back into the charging-port jamb 25 with the aid of the lid lifter 26.

The invention claimed is:

1. An apparatus for charging chambers of a coke oven having a top wall provided with charging ports spaced apart in a longitudinal direction, the apparatus comprising a horizontal screw conveyor mounted underneath a coal-charging larry cart, having a downwardly open outlet, and movable in the longitudinal direction, a telescopic charging chute provided below the outlet of the horizontal screw conveyor and having an upper intake funnel and a telescopic lower part that can be lowered vertically into the charging ports of the coke oven and that is displaceable horizontally in the longitudinal direction and in a transverse direction orthogonal to the longitudinal direction relative to the cart for alignment with the charging ports, a support frame carrying the intake funnel, a lifter carried on the support frame for vertically displacing the telescopic lower part, a traveling frame in which the support frame is movable in a straight line in the transverse direction, the traveling frame being horizontally movable in the longitudinal direction on rails mounted on the lower side of the coal-charging larry cart, and a seal on a top side of the support frame that surrounds the intake funnel of the telescopic charging chute, works together with a horizontal lower flange surface on the outlet of the horizontal screw conveyor, and permits horizontal movement of the intake funnel relative to the outlet of the horizontal screw conveyor.

2. The apparatus according to claim 1, wherein the rails for the traveling frame extend in the longitudinal direction, and the support frame is guided so it is movable on the traveling frame in the transverse direction.

3. The apparatus according to claim 1, wherein the traveling frame and the support frame lie in a common plane.

4. The apparatus according to claim 3, wherein the traveling frame and the support frame are constructed from U-profiles and the support frame has rollers running in the U-profiles of the traveling frame.

5. The apparatus according to claim 1, wherein the rails for the traveling frame are U-profiles suspended by beams on the coal-charging larry cart and are horizontally open, and the traveling frame has rollers that run in the horizontally open rails.

6. The apparatus according to claim 1, wherein the lifter for the telescopic charging chute has a lifting frame guided on a vertical beam, movable by a hydraulic actuator along the vertical beam, and connected by pivoted links to the telescopic lower part, the vertical beam of the lifter being fixed to the support frame horizontally offset from the horizontal screw conveyor.

7. The apparatus according to claim 1, wherein the seal is adjustable in operation and does not touch the flange surface surrounding the outlet of the horizontal screw conveyor during horizontal movement of the telescopic charging chute but presses against the flange surface to form a seal during coal charging.

8. The apparatus according to claim 7, wherein the seal is a diaphragm, a bellows, or a hose accommodated in an annular chamber and expandable by compressed air.

9. The apparatus according to claim 1, wherein the intake funnel has a cylindrical region surrounded by a cylindrical region of the telescopic lower part, and a peripheral seal is provided on the surface between the cylindrical regions of the intake funnel and of the telescopic lower part.

10. The apparatus according to claim 9, wherein the peripheral seal permits an essentially contactless adjustment movement of the telescopic lower part.

11. The apparatus according to claim 1, further comprising:

hydraulic actuators connected to proximity detectors and attached to the support frame and to the traveling frame.

12. The apparatus according to claim 11, further comprising:

a machine controller connected to the hydraulic actuators for holding position data of the charging ports.

13. The apparatus according to claim 11, further comprising:

an optical distance sensor controlling the hydraulic actuators, provided on the coal-charging larry cart, for sensing positions of the charging ports.

14. The apparatus according to claim 13, further comprising:

at least one carriage inside the support frame and movable along the support frame, and a lid lifter or a cleaner of the charging-port jambs fixed to the carriage.

15. The apparatus according to claim 14, wherein the lifter provided on the carriage has a vertically adjustable support arm movable on movement of the carriage into a free space between the raised telescopic lower part of the telescopic charging chute and the charging-port jamb.

16. The apparatus according to claim 14, further comprising:

at least one hydraulic actuator engaging the carriage and provided on the support frame.

* * * * *